US007171695B2

(12) United States Patent
Braun

(10) Patent No.: US 7,171,695 B2
(45) Date of Patent: Feb. 6, 2007

(54) VENTILATED GARMENT WITH VENT OPENING SYSTEM

(75) Inventor: David C. Braun, Milwaukee, WI (US)

(73) Assignee: Harley-Davidson Motor Company Group, Inc., Milwaukee, WI (US)

( * ) Notice: Subject to any disclaimer, the term of this patent is extended or adjusted under 35 U.S.C. 154(b) by 230 days.

(21) Appl. No.: 10/448,742

(22) Filed: May 30, 2003

(65) Prior Publication Data

US 2004/0237168 A1 Dec. 2, 2004

(51) Int. Cl.
*A41D 1/02* (2006.01)

(52) U.S. Cl. ..... 2/93; 2/DIG. 1; 2/247

(58) Field of Classification Search ..... 2/2.17, 2/69, 69.5, 102, 85–97, 100, 108, 171.4, 2/182.2, 182.3, 184.5, 175.7, 217, 269, DIG. 1, 2/227, 228, 312, 316, 247–250
See application file for complete search history.

(56) References Cited

U.S. PATENT DOCUMENTS 1,695,590 A * 12/1928 Jensen ..... 2/74
3,448,463 A * 6/1969 Milone ..... 2/234
4,513,451 A * 4/1985 Brown ..... 2/69
4,578,828 A * 4/1986 Smith et al. ..... 2/234
5,263,201 A * 11/1993 Hood ..... 2/234
5,299,323 A * 4/1994 Schaefer et al. ..... 2/93
5,417,273 A * 5/1995 Bamonte ..... 160/368.1
5,570,473 A * 11/1996 Andries ..... 2/93
5,577,306 A * 11/1996 Gold ..... 24/715.3
5,642,526 A * 7/1997 Thompson ..... 2/79
6,070,274 A * 6/2000 van der Sleesen ..... 2/456
6,125,472 A * 10/2000 Nakagawa ..... 2/115
6,161,223 A * 12/2000 Andrews ..... 2/234
6,163,883 A * 12/2000 Hong ..... 2/69
6,263,510 B1 * 7/2001 Bay et al. ..... 2/93
6,282,717 B1 * 9/2001 Ng ..... 2/70
6,308,334 B1 * 10/2001 Maas ..... 2/69
6,317,894 B1 * 11/2001 Blechman ..... 2/269
6,339,845 B1 * 1/2002 Burns et al. ..... 2/243.1
6,546,561 B2 * 4/2003 Duhamell ..... 2/102
6,742,225 B2 * 6/2004 Marty et al. ..... 24/382
6,795,976 B1 * 9/2004 van der Sleesen ..... 2/69
6,848,119 B2 * 2/2005 Crye et al. ..... 2/247
6,859,944 B2 * 3/2005 Kim ..... 2/237
6,868,557 B1 * 3/2005 van der Sleesen ..... 2/93
6,993,792 B2 * 2/2006 Marty et al. ..... 2/69

(Continued)

*Primary Examiner*—Alissa L. Hoey
(74) *Attorney, Agent, or Firm*—Michael Best & Friedrich LLP

(57) ABSTRACT

A ventilated garment includes a body portion, a vent opening defined by the body portion, and a vent closure coupled to the vent opening. The vent opening has an opened configuration and a closed configuration, and the vent closure secures the vent opening in the closed configuration. The ventilated garment also includes a pull that is coupled to the vent closure and extends along the body portion. The pull has a first exposed portion that is spaced from the vent closure and that affords remote operation of the vent closure to adjust the vent opening from the opened configuration to the closed configuration, and a second exposed portion that is spaced from the vent closure and that affords remote operation of the vent closure to adjust the vent opening from the closed configuration to the opened configuration. The exposed portions of the pull may be positioned in pockets of the ventilated garment.

23 Claims, 5 Drawing Sheets

U.S. PATENT DOCUMENTS

2003/0024028 A1* 2/2003 Sleesen ..... 2/2.17
2003/0033656 A1* 2/2003 Jaeger ..... 2/69
2003/0140404 A1* 7/2003 Golde ..... 2/465
2003/0188371 A1* 10/2003 Duhammel et al. ..... 2/102
2005/0172381 A1* 8/2005 Bush et al. ..... 2/249

* cited by examiner

VENTILATED GARMENT WITH VENT OPENING SYSTEM

FIELD OF THE INVENTION

The present invention relates to body garments, and more specifically to body garments having ventilation openings.

BACKGROUND

Body garments including jackets, pants, body suits, and the like are often provided with specially configured openings that allow additional amounts of air to flow through the garment. These dedicated openings, generally referred to as vents, are often adjustable between opened and closed positions so that a wearer may control the flow of air through the garment depending on the surrounding conditions. In this regard, garments having vents are distinguished from garments made of perforated fabrics or other highly breathable materials. Known closure devices such as zippers, hook and loop closures, buttons, and the like are often used to selectively close and open the vents.

Garments having vents, hereinafter referred to generally as "ventilated garments", are particularly appropriate for certain types of activities. Examples of activities where participants commonly utilize ventilated garments include skiing, motorcycling, and other activities that are generally performed outdoors, and in which the wearer may be subjected to widely varying conditions. Although the most common type of ventilated garment is generally a ventilated jacket, ventilated pants and ventilated body suits have also been developed for various activities.

SUMMARY OF THE INVENTION

The present invention provides a ventilated garment including a body portion, a vent opening defined by the body portion, and a vent closure coupled to the vent opening. The vent opening has an opened configuration and a closed configuration, and the vent closure is provided to secure the vent opening in the closed configuration. The ventilated garment also includes a pull that is coupled to the vent closure and that extends along the body portion. The pull has an exposed portion that is spaced from the vent closure and that affords remote operation of the vent closure to adjust the vent opening from at least one of the opened and closed configurations to the other of the opened and closed configurations.

The present invention also provides a method for adjusting a vent opening of a ventilated garment between opened and closed configurations. The ventilated garment in question includes a body portion that defines the vent opening, a vent closure coupled to the vent opening for securing the vent opening in the closed configuration, and a pull coupled to the vent closure. The pull has a first portion that extends along the body portion to a first location that is spaced from the vent opening, and a second portion that extends along the body portion to a second location that is spaced from the vent opening. The method includes reaching toward the first location while the vent opening is in the closed configuration and grasping the first portion of the pull. The first portion is pulled to move the vent closure, which thereby adjusts the vent opening from the closed configuration toward the opened configuration.

Other features of the invention will become apparent to those skilled in the art upon review of the following detailed description, claims, and drawings.

Figure 1:
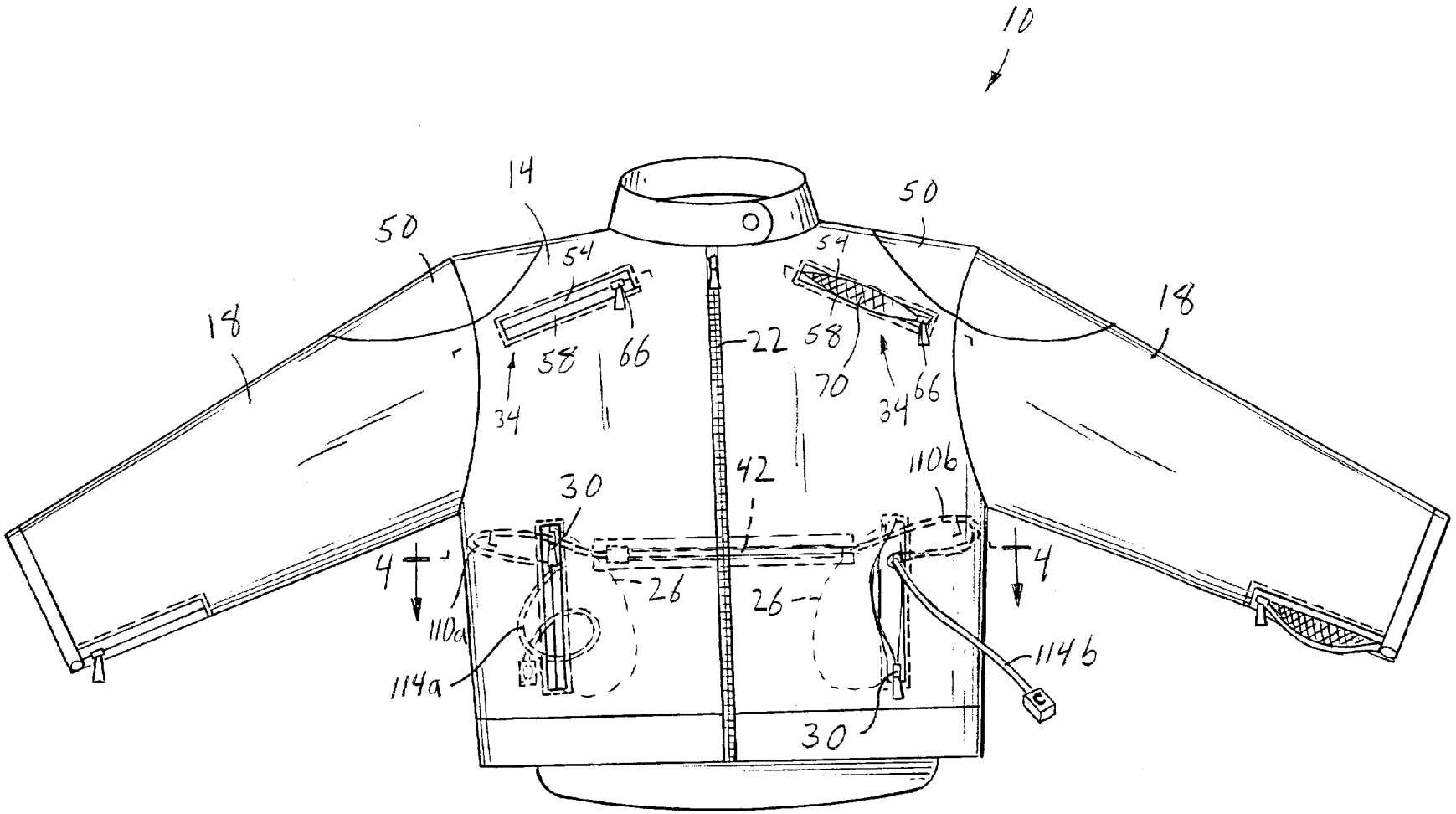
FIG. 1 is a front view of a ventilated garment embodying the invention.

Before one embodiment of the invention is explained in detail, it is to be understood that the invention is not limited in its application to the details of construction and the arrangements of the components set forth in the following description or illustrated in the drawings. The invention is capable of other embodiments and of being practiced or being carried out in various ways. Also, it is understood that the phraseology and terminology used herein is for the purpose of description and should not be regarded as limiting. The use of "including" and "comprising" and variations thereof herein is meant to encompass the items listed thereafter and equivalents thereof as well as additional items.

DETAILED DESCRIPTION

Figure 2:
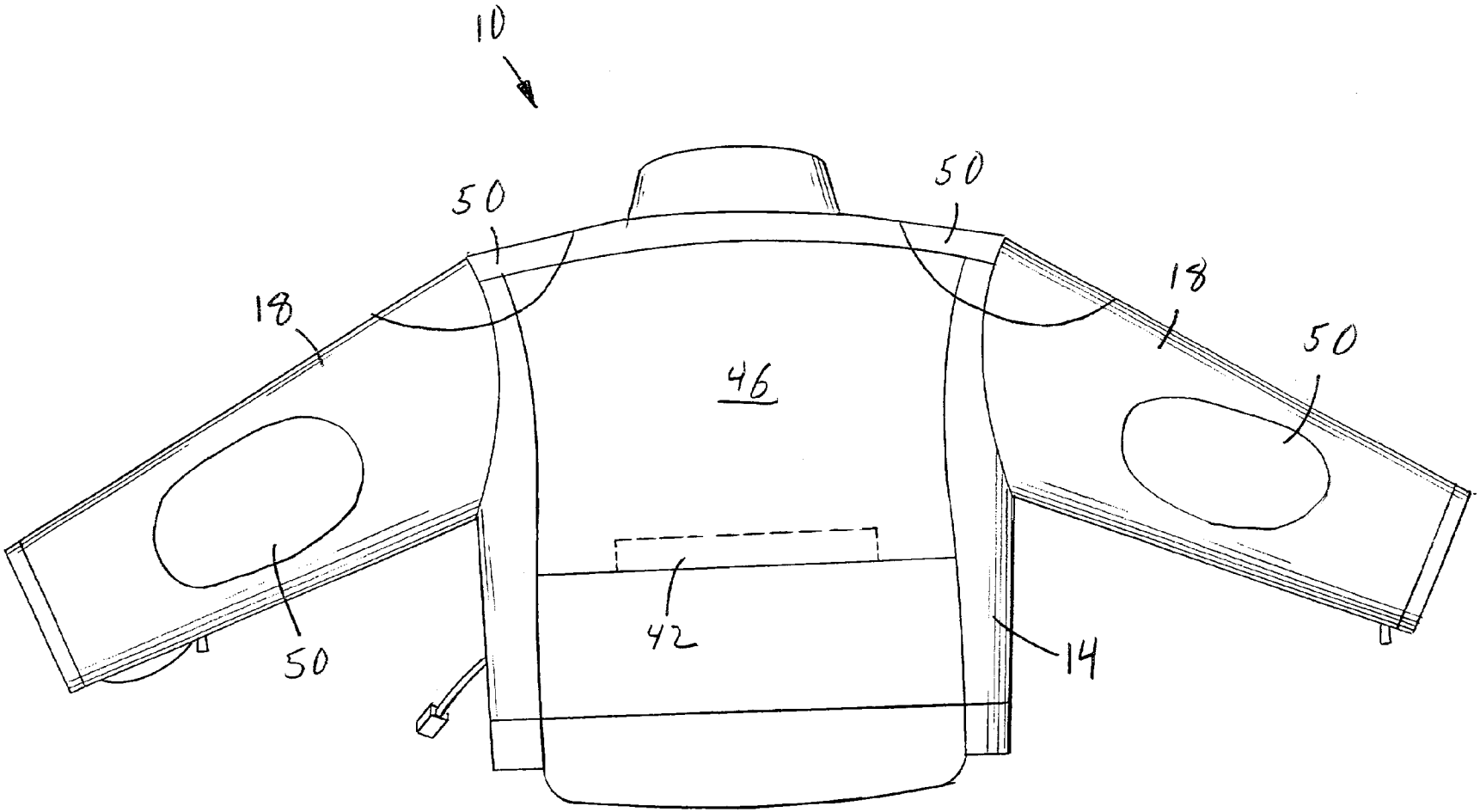
FIG. 2 is a back view of the ventilated garment illustrated in FIG. 1.

FIGS. 1 and 2 illustrate a ventilated garment in the form of a ventilated jacket 10 embodying the invention. The jacket 10 includes a body portion having a torso portion 14 and extremity portions in the form of sleeves 18 coupled to the torso portion 14. The jacket 10 includes a main zipper 22 extending along the front of the torso portion 14, which facilitates donning and doffing of the jacket 10. Pockets 26 are defined in the front of the torso portion 14 on each side of the main zipper 22 and, in the illustrated embodiment, may be selectively opened and closed by pocket zippers 30. Chest vents 34 are also defined in the front of the torso portion 14 and may be selectively opened and closed by vent zippers 38 to control air flow through the jacket 10. A back vent 42, discussed further below, extends across a back section 46 of the torso portion 14 and is also selectively opened and closed for controlling air flow through the jacket 10. Depending on the particular application for which the jacket is intended, armor sections 50 may be provided in various portions of the jacket 10, such as the shoulder and/or elbow areas, for example.

While the garment illustrated in FIGS. 1 and 2 is a jacket 10, it should be appreciated that the garment could also be in the form of a vest, in which case the sleeves 18 would be eliminated. Furthermore, the positioning and quantity of pockets 26 and vents 34 can vary significantly. For example, more or fewer pockets 26 may be provided in different areas of the torso portion 14, or on the sleeves 18 if desired. Also, more or fewer vents may be provided and may be positioned and oriented in a variety of ways on any portion of the jacket 10.

The chest vents 34 each include an upper edge 54 and a lower edge 58. Selectively joinable rows of zipper teeth (not shown) are coupled to each edge 54, 58 and a zipper slider 66 can be moved from one end of the chest vent 34 to the other to engage and disengage the rows of zipper teeth, thereby opening and closing the chest vent 34. A swatch of perforated fabric 70 is coupled to each edge 54, 58 and extends across the chest vent 34 when the vent 34 is opened.

When the chest vent 34 is opened, air flows through the perforated fabric 70 and circulates through the jacket 10 to cool the wearer.

Figure 3:
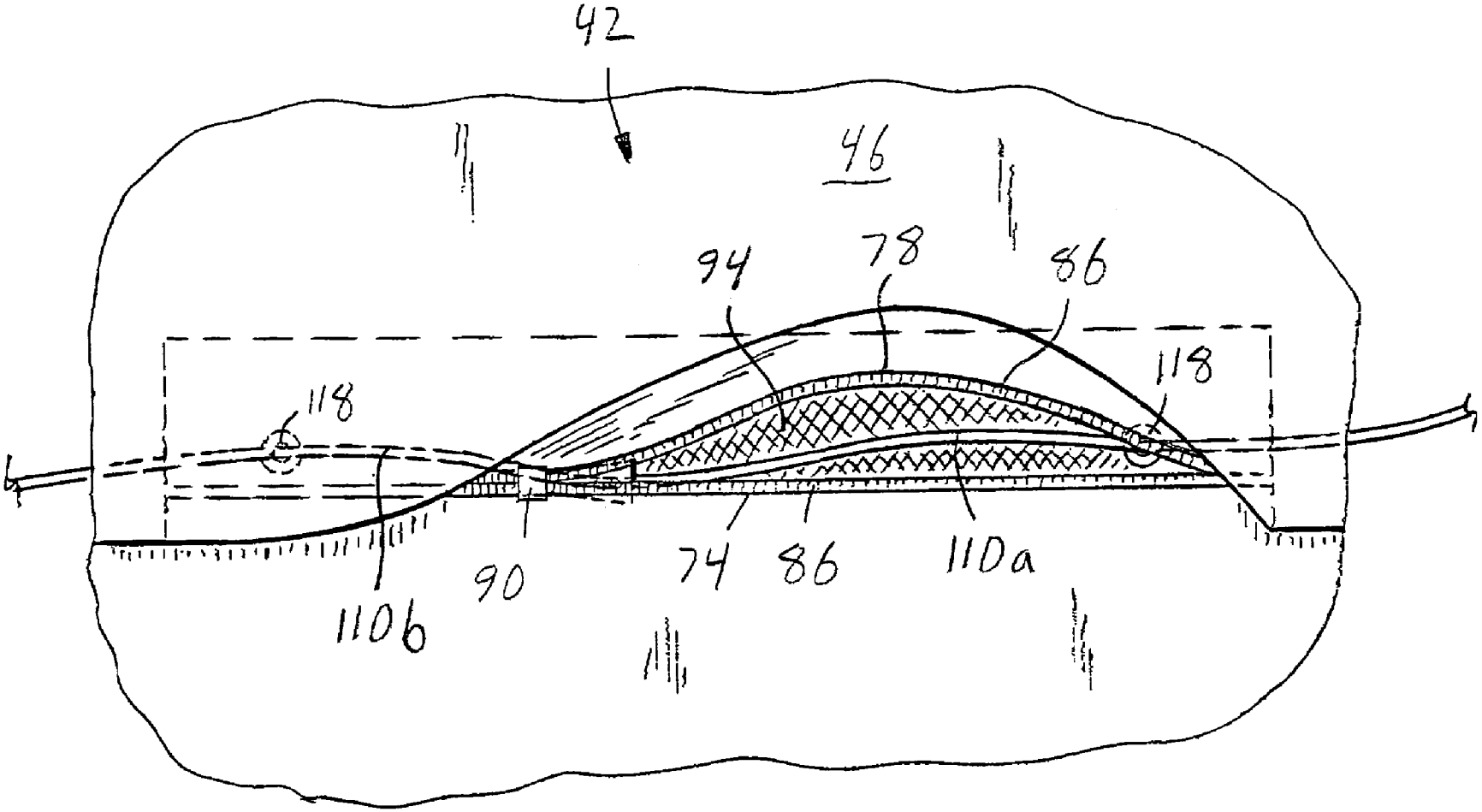
FIG. 3 is an enlarged view of a back vent area of the ventilated garment illustrated in FIG. 2.
Figure 4:
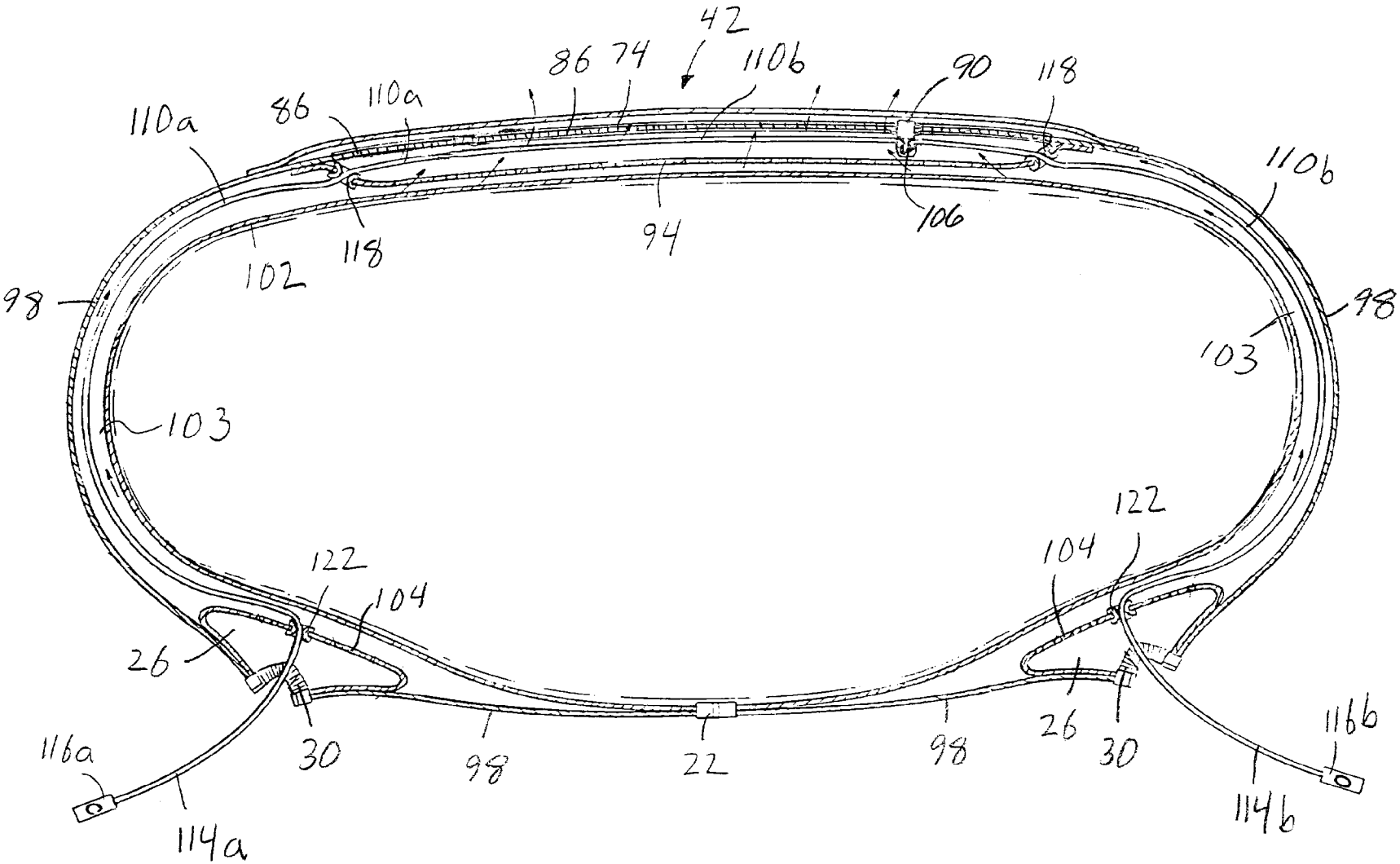
FIG. 4 is a section view taken along line 4—4 of FIG. 1.

FIGS. 3 and 4 illustrate the back vent 42 in further detail. The back vent 42 includes a first edge 74 and a second edge 78 that extend across the back section 46 of the torso portion 14 and that define a vent opening 82. The vent opening 82 can be adjusted between an opened configuration, in which the first and second edges 74, 78 are spaced from one another, and a closed configuration, in which the first and second edges 74, 78 are coupled to one another. Specifically, a vent closure in the form of a zipper having a row of zipper teeth 86 coupled to each respective edge 74, 78, and a zipper slider 90 are provided to selectively secure the vent opening 82 in the closed configuration. The slider 90 can be moved from one end of the vent opening 82 to the other to selectively couple and decouple the rows of zipper teeth 86 from one another, thereby adjusting the vent opening 82 between the opened and the closed configurations. A swatch of perforated fabric 94 is coupled to the first and second edges 74, 78 and extends across the vent opening 82 when the vent opening 82 is in the opened configuration.

FIG. 4 illustrates additional components of the jacket 10 that afford remote operation of the back vent 42 such that a wearer can more easily adjust the vent opening 82 between the opened and closed configurations. The illustrated jacket 10 includes an outer fabric layer 98 and an inner fabric layer 102. In some embodiments, the outer fabric layer 98 is a heavy duty, abrasion resistant fabric, and the inner fabric layer 102 is a waterproof/breathable fabric, or can also be a perforated fabric. Slits formed in the outer fabric layer 98 define the vents 34, 42 such that air may flow into the interior of the jacket 10 when the vents 34, 42 are opened. An intermediate space 103 is defined between the outer and inner fabric layers 98, 102. The jacket 10 also includes pocket liners 104 that, in the illustrated construction, are coupled to the outer fabric layer 98 to form the pockets 26. In alternative constructions, the pocket liners 104 may be formed from or integral with either the outer fabric layer 98 or the inner fabric layer 102, depending upon the particular construction of the jacket 10.

With reference to the back vent 42, the slider 90 of the zipper assembly includes a coupling portion in the form of a hook 106 that is position inwardly of the outer fabric layer 98. More specifically, the hook 106 is positioned in the intermediate space 103 between the outer and inner fabric layers 98, 102, but is positioned outwardly of the perforated fabric 94. In the illustrated construction, a pull in the form of a cord 110 is coupled to the hook 106 and extends through the intermediate space along the body portion and into the pockets 26 defined in the front of the torso portion 14. The jacket wearer can therefore reach into either jacket pocket 26, grasp an exposed portion 114 of the cord 118, and pull on the exposed portion 114 to move the slider 90. Moving the slider adjusts the vent opening 82 either from the opened configuration to the closed configuration, or from the closed configuration to the opened configuration, depending on which exposed portion 114 is pulled. In the illustrated embodiment, pulling on the exposed portion 114*a* in the right pocket 26 closes the vent opening 82, and pulling on the exposed portion 114*b* in the left pocket 26 opens the vent opening 82. In the illustrated embodiment, the exposed portion 114*a* includes an end clip 116*a* that is labeled with a "C" and the exposed portion 114*b* includes an end clip 116*b* that is labeled with an "O", the letters being indicative of the purpose of each exposed portion 114. Of course the operating configuration can be reversed, if desired.

More specifically, the cord 110 includes a first portion 110*a* that extends away from the hook 106 in a first direction, toward the wearer's right band side. The first portion 110*a* extends through a first guide in the form of a metal grommet 118 that is surrounded by a portion of the outer fabric layer 98 that extends into the intermediate space 103 and is coupled to the perforated fabric 94. The grommet 118 provides an opening that communicates with the vent opening 82 and the intermediate space 103. The first portion 110*a* therefore extends through the opening defined by the grommet 118, into the intermediate space 103, and toward the right-hand pocket 26. A second grommet 122 is positioned in the pocket liner 104 and provides an opening through which the first portion 110*a* extends into the pocket 26. The exposed portion 114*a* may therefore reside inside the pocket 26 until such time as the wearer desires to close the vent opening 82 (see FIG. 1). Although the exposed portion 114 is inside the pocket, as used herein, "inside the pocket" is still considered to be outside of the jacket 10, regardless of whether the pocket 26 is opened or closed.

A second portion of the cord 110*b* similarly extends away from the hook 106 in a second direction, toward the wearer's left-hand side. The second portion 110*b* extends through similar grommets 118, 122 positioned in a similar portion of the outer fabric layer 98 and the pocket liner 104, respectively, and into the left-hand pocket 26. The exposed portion 114*b* may therefore reside inside the pocket 26 until such time as the wearer desires to open the vent opening 82. Pulling on the exposed portion 114*b* moves the slider 90 in a direction that decouples the rows of zipper teeth 86 from one another and opens the vent opening 82. When the vent opening 82 is fully opened, the exposed portion 114*b* may be tucked back inside the pocket 26.

In the illustrated embodiment, the cord 110 is a single, continuous strand having a central portion that is tied to the hook 106. It should be readily apparent to one of ordinary skill in the art that two individual cords that are each tied to or otherwise coupled to the slider 90 could alternatively be provided. The single cord could likewise be coupled to the slider 90 in a variety of ways. Other types of pulling or tensile members could also replace the cord 110. Chains, ribbons, bands, strips, and the like, fabricated from various types of materials and having substantially any type of construction, can all be substituted for the above-described cord 110.

In addition, the jacket construction can vary greatly from the illustrated construction. Although the inner fabric layer 102 of the illustrated jacket 10 extends along the entire interior of the jacket, the inner fabric layer 102 could be partially or completely eliminated, or additional fabric layers could also be provided. For example, a partial inner fabric layer 102 could be stitched to the outer fabric layer only in the vicinity of the cord 110, thereby defining a channel or passageway through which the cord 110 extends. Additional guides in the form of fabric loops or additional grommets through which the cord 110 extends may also be provided, if desired. The perforated fabric 94 could also be eliminated from the jacket construction in which case the cord 110 may only extend through the grommet 122 that is positioned in the pocket liner 104. Various combinations of the above-described constructions are also contemplated, and are within the spirit and scope of the present invention.

While the positioning of the hook 106 on the inside of the jacket 10 provides certain advantages with respect to jacket construction and aesthetic appeal, the hook 106 could also be positioned on the outside of the jacket 10. Similarly, some portions of the cord 110 could be positioned or extend along the outside of the jacket 10. In this regard, external guides including additional fabric portions or addition grommets can be provided, and may be configured similarly to conventional belt loops, for example.

Figure 5:
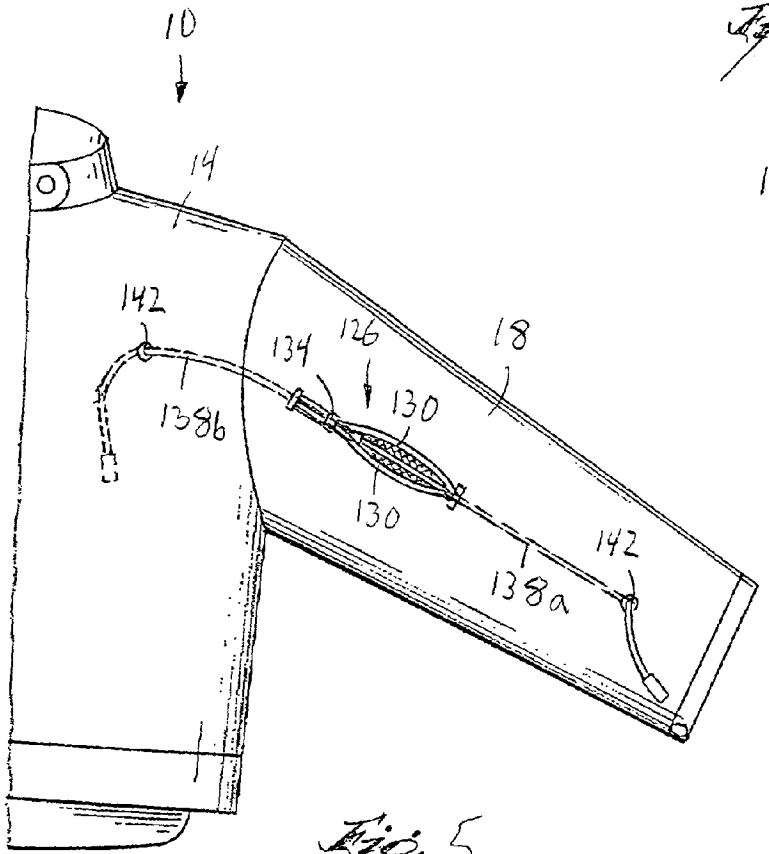
FIG. 5 is a front view of a portion of a ventilated garment that is an alternate embodiment of the invention.

As mentioned above, the vents 34, 42 can be positioned substantially anywhere on the ventilated garment. For example, FIG. 5 illustrates a sleeve vent 126 that is configured for remote operation similar to the back vent 42. The sleeve vent 126 includes a vent closure in the form of zipper teeth 130 and a slider 134 that can be moved to engage and disengage the zipper teeth 130, thereby opening and closing the sleeve vent 126. A cord 138, which may or may not be similar to the cord 110, is coupled to the slider and includes first and second portions 138*a*, 138*b* that extend in opposite directions to afford remote operation of the vent closure to open and close the sleeve vent 126. As illustrated, the first portion 138*a* extends toward the wearer's wrist, and the second portion 138*b* extends toward the wearer's shoulder/chest area. Grommets 142 are provided to guide the first and second portions 138*a*, 138*b* through the jacket sleeve 18. Of course other configurations are possible as well.

Figure 6:
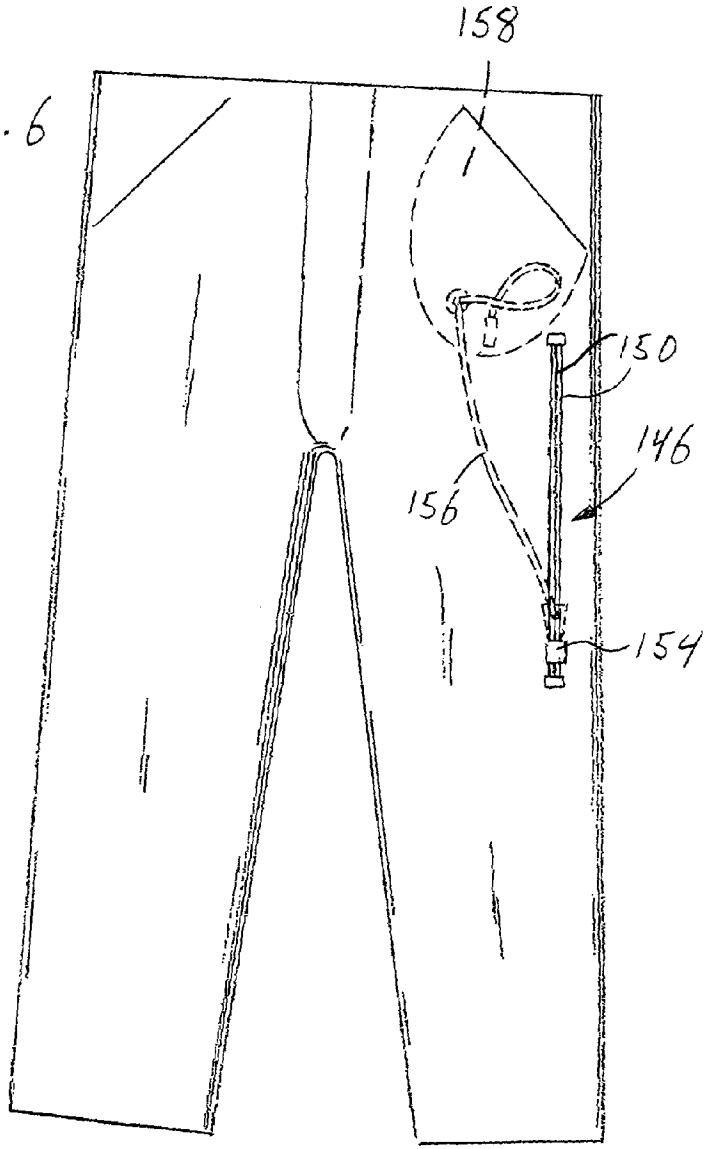
FIG. 6 is a front view of a portion of a ventilated garment that is a second alternate embodiment of the invention.

Viewing FIG. 6, a ventilated garment in the form of a pair of pants 142 is illustrated as including a leg vent 146 configured to operate in accordance with at least some teachings of the present invention. The leg vent 146 includes rows of zipper teeth 150 and a slider 154 that can be moved to couple and decouple the zipper teeth 150. A cord 156 is coupled to the slider 154 and extends into a pocket 158 of the pants 142 such that the leg vent 146 can be either opened or closed by pulling on the cord 156. As illustrated, the leg vent 146 is configured for remote operation only from the opened to the closed configuration, or from the closed to the opened configuration, depending on the orientation of the zipper. However, in view of the teachings presented above, the leg vent 146 could also be configured for remote operation between both the opened and closed configurations. Furthermore, a unitary body suit incorporating some or all of the features of both the jacket 10 and pants 142 discussed above may also be provided.

Although each vent closure described above has been in the form of a zipper assembly, it should be appreciated that many different types of closure devices are well known in the art, and may be utilized in combination with or in place of the above-described zipper assemblies. For example, hook and loop type closures may be provided to secure the vents in the closed configurations. Cords similar to those discussed above, or other types of pulls, may be coupled to the hook and loop closure portions such that pulling on one cord separates the hook and loop closure portions, and pulling on an alternate cord brings the hook and loop closure portions back into a mating engagement. The use of other closure mechanisms incorporating various combinations of buttons, snaps, and the like are also contemplated.

Various features of the invention are set forth in the following claims.

The invention claimed is:

1. A ventilated garment comprising:

a body portion;

a vent opening defined by the body portion;

a vent closure adjacent the vent opening and moveable between an opened configuration and a closed configuration; and a pull coupled to the vent closure and having a first portion extending from the vent closure in a first direction for remote operation of the vent closure from the opened position to the closed position, and a second portion extending from the vent closure in a second direction for remote operation of the vent closure from the closed position to the opened position, wherein the vent closure comprises rows of zipper teeth selectively joined by a slider, and wherein the pull is coupled to the slider.

2. The ventilated garment of claim 1, wherein the vent opening includes a first edge and a second edge, wherein when the vent opening is in the closed configuration, the first and second edge are coupled to one another by the vent closure, and wherein when the vent opening is in the opened configuration, the first and second edges are spaced from one another to afford air flow through the vent opening.

3. The ventilated garment of claim 1, further comprising a pocket defined in the body portion, and wherein one of the first portion and the second portion of the pull extends into the pocket.

4. The ventilated garment of claim 3, wherein the body portion defines a guide disposed between the vent closure and the pocket, and wherein the pull extends through the guide.

5. The ventilated garment of claim 4, wherein the guide comprises a fabric-surrounded opening.

6. The ventilated garment of claim 1, wherein the vent opening extends along a back section of the body portion.

7. The ventilated garment of claim 1, wherein the pull is coupled to the slider inside the ventilated garment, and wherein one of the first portion and the second portion extends through the ventilated garment and is positioned outside of the ventilated garment.

8. The ventilated garment of claim 1, wherein the pull comprises a continuous cord having a central portion coupled to the vent closure.

9. The ventilated garment of claim 1, wherein the body portion comprises a torso portion and an extremity portion, and wherein the vent opening is defined by at least one of the torso portion and the extremity portions.

10. The ventilated garment of claim 9, wherein the extremity portion is a leg portion.

11. The ventilated garment of claim 9, wherein the extremity portion is a sleeve portion.

12. A ventilated garment comprising:

a body portion including an inner fabric layer and an outer fabric layer;

a vent opening defined by the body portion and extending through at least the outer fabric layer, the vent opening having an opened configuration and a closed configuration;

a vent closure coupled to the vent opening for securing the vent opening in the closed configuration;

a pocket defined in the body portion, the vent closure being outside the pocket; and a pull coupled to the vent closure and extending between the inner fabric layer and the outer fabric layer, the pull having a portion extending into the pocket when the vent opening is in the closed configuration and affording remote operation of the vent closure to adjust the vent opening from at least one of the opened and closed configurations to the other of the opened and closed configurations.

13. The ventilated garment of claim 12, wherein the vent opening includes a first edge and a second edge, wherein when the vent opening is in the closed configuration, the first and second edge are coupled to one another by the vent closure, and wherein when the vent opening is in the opened configuration, the first and second edges are spaced from one another to afford air flow through the vent opening.

14. The ventilated garment of claim 12, wherein the vent closure comprises a zipper including rows of zipper teeth and a slider, and wherein the pull is coupled to the slider for movement thereof.

15. The ventilated garment of claim 12, wherein the inner fabric layer and the outer fabric layer cooperate to define an intermediate space that extends between the vent closure and the pocket, and wherein the pull extends through the intermediate space.

16. The ventilated garment of claim 12, wherein the pull includes a first portion extending from the vent closure in a first direction and affording remote operation of the vent closure to adjust the vent opening from the closed configuration to the opened configuration, and a second portion extending from the vent closure in a second direction and affording remote operation of the vent closure to adjust the vent opening from the opened configuration to the closed configuration.

17. The ventilated garment of claim 16, further comprising an additional pocket defined in the front body portion, wherein one of the first and second portions extends into one of the pockets, and the other of the first and second portions extends into the other of the pockets.

18. A ventilated garment comprising:

a body portion;

a vent opening defined by the body portion;

a vent closure adjacent the vent opening and moveable between an opened configuration and a closed configuration; and a pull coupled to the vent closure and having a first portion extending from the vent closure in a first direction for remote operation of the vent closure from the opened position to the closed position, and a second portion extending from the vent closure in a second direction for remote operation of the vent closure from the closed position to the opened position, wherein the first portion extends through the body portion to a first location spaced from the vent opening, and wherein the second portion extends through the body portion to a second location spaced from the vent opening.

19. The ventilated garment of claim 18, wherein the first and second locations are defined by first and second pockets respectively, and wherein each pocket is defined by the body portion.

20. The ventilated garment of claim 18, wherein the vent closure comprises rows of zipper teeth selectively joined by a slider, and wherein the pull is coupled to the slider.

21. The ventilated garment of claim 20, wherein the vent opening is defined by a back portion of the body portion, and wherein the first and second portions extend into respective pockets defined by a front portion of the body portion.

22. A method for adjusting a vent opening of a ventilated garment between opened and closed configurations, the ventilated garment including a body portion that defines the vent opening, a vent closure coupled to the vent opening for securing the vent opening in the closed configuration, and a pull coupled to the vent closure and having a first portion extending along the body portion to a first location remotely spaced from the vent opening, and a second portion extending along the body portion to a second location remotely spaced from the vent opening, the method comprising:

reaching toward the first location while the vent opening is in the closed configuration;

grasping the first portion of the pull;

pulling the first portion to move the vent closure and to thereby adjust the vent opening from the closed configuration toward the opened configuration;

reaching toward the second location while the vent opening is in the opened configuration;

grasping the second portion of the pull; and pulling the second portion to move the vent closure and to thereby adjust the vent opening from the opened configuration toward the closed configuration.

23. The method of claim 22, wherein the first and second locations are within first and second pockets respectively, each pocket defined by the body portion, and wherein reaching toward the first location comprises reaching into the first pocket.

* * * * *